US005179363A

United States Patent [19]

Schwartz et al.

[11] Patent Number: 5,179,363

[45] Date of Patent: Jan. 12, 1993

[54] STRESS RELIEVED IRIS IN A RESONANT CAVITY STRUCTURE

[75] Inventors: Craig N. Schwartz, Torrance; Rolf Kich, Redondo Beach, both of Calif.

[73] Assignee: Hughes Aircraft Company, Los Angeles, Calif.

[21] Appl. No.: 669,252

[22] Filed: Mar. 14, 1991

[51] Int. Cl.[5] ..... H01P 7/06

[52] U.S. Cl. ..... 333/229; 333/230

[58] Field of Search ..... 333/230, 229, 227, 234, 333/212, 248

[56] References Cited

U.S. PATENT DOCUMENTS

| | | | |
|---|---|---|---|
| 4,260,967 | 4/1981 | Flieger | 333/229 X |
| 4,488,132 | 12/1984 | Collins et al. | 333/230 X |
| 4,677,403 | 6/1987 | Kich | 333/229 |

FOREIGN PATENT DOCUMENTS

| | | | |
|---|---|---|---|
| 2040592 | 8/1980 | United Kingdom | 333/229 |

*Primary Examiner*—Paul M. Dzierzynski

*Assistant Examiner*—Benny Lee

*Attorney, Agent, or Firm*—Gordon R. Lindeen, III; Wanda K. Denson-Low

[57] ABSTRACT

An iris for an electromagnetic structure, such as a resonator assembly, is provided with a set of grooves introducing relief to thermally induced stresses, this allowing the iris to be fabricated of a metal having a greater coefficient of thermal expansion than the material of a sidewall and end walls of the resonator assembly. The grooves are arranged spaced apart from the central coupling aperture, and are disposed in an annular region of the iris plate composing the central coupling aperture. The grooves may be cut into the iris plate from both sides of the plate to extend partway into the plate, typically, approximately three-quarters of the distance through the plate. Alternatively, the grooves may pass completely through the plate, whereupon annular disks are soldered to the opposite sides of the iris plate to close off the grooves to ensure that coupling of electromagnetic power between opposite sides of the iris takes place only through the coupling aperture.

14 Claims, 3 Drawing Sheets

STRESS RELIEVED IRIS IN A RESONANT CAVITY STRUCTURE

BACKGROUND OF THE INVENTION

This invention relates to the construction of an iris employed in an electromagnetic wave structure and, more particularly, to the construction of an iris with thermal stress relief grooves which allow for differential expansion of a metallic plate from which the iris is constructed relative to a metallic housing of the electromagnetic wave structure.

Irises are commonly employed in the coupling of electromagnetic waves between chambers in a structure which supports traveling and/or standing waves. One example of an electromagnetic wave structure of considerable interest herein is a resonator used in the construction of a microwave filter. For example, the filter may comprise two cylindrical chambers enclosed within the cylindrical metallic wall of a housing of the filter. Each chamber is provided with an end metallic wall, the two chambers being coupled by one or more coupling apertures in an iris disposed at a central location of the housing between the two end walls. In the event that both chambers are to resonate at the same frequency, the iris is positioned equally distant between the two end walls. In the event that the chambers are to resonate at slightly different frequencies, then the location of the iris may be offset slightly from the central location between the two end walls.

Particularly in the case of resonators employed in microwave filters, it has been the practice to construct the metallic walls of the filter of a metal which has a low coefficient of thermal expansion so as to minimize changes in the physical dimensions of the filter in the presence of changing temperature. For example, in the event that the microwave filter is used in the transmission of intense electromagnetic power, a significant amount of heating occurs within the walls of the filter. The heating produces expansion of the housing and other elements of the filter with a resultant shift in the resonance frequency of the various resonators or chambers within the filter. The electrically conductive metal, a 36% nickel steel alloy commonly sold under the name Invar, Invar alloy is frequently employed because of its very low coefficient of thermal expansion.

However, a problem arises in that a metal, such as aluminum, is preferable for the construction of the iris because such metal is of lighter weight, has better heat flow properties, and is easier to machine than a metal such as Invar. Therefore, it would be preferable to construct the iris of a plate of aluminum. However, due to the much larger coefficient of thermal expansion of aluminum, as compared to the relatively low thermal coefficient of expansion of Invar alloy, the aluminum expands much more than does the Invar alloy in the presence of heating of the filter, or other microwave structure in which the iris may be employed. As a result, the iris buckles, resulting in a distortion of the iris, and also presents an intrusion of a central portion of the iris into one of the chambers. This has the effect of a reduction in a longitudinal dimension of the chamber with an increase in the longitudinal dimension of the other chamber. As a result of the dimensional changes of the two chambers, the shortened chamber is detuned to a higher frequency and the lengthened chamber is detuned to a lower frequency. Also, distortions in the surface of the iris may result in an altered bandpass characteristic of each of the chambers. Thus, operation of the filter may be degraded significantly.

SUMMARY OF THE INVENTION

The aforementioned problem is overcome and other advantages are provided, in accordance with the invention, by the construction of an iris in an electromagnetic wave structure wherein stress relief for thermally induced stresses is accomplished by the formation of trough-like depressions, or grooves, within a surface of the iris plate. In a preferred embodiment of the invention, each of the grooves has a linear shape, and is parallel to a tangent to a circle which encloses a central coupling aperture of the iris.

By way of example, the iris may be employed in a cylindrical microwave structure for dividing the structure into two chambers, such as in the construction of a microwave filter. The iris comprises a circular plate affixed by a flange to the microwave structure, and is provided with a coupling aperture which, by way of example, may have the form of a cross. Typically, such an aperture is disposed at a center of the iris plate. Each of the grooves is spaced apart from the coupling aperture, and extends to a point adjacent the outer encircling wall of the microwave structure.

The grooves are arranged uniformly about the iris plate and, in the case of the centrally disposed coupling aperture, are disposed in an array having circular symmetry about a central axis of the iris. Each of the grooves has a length which is less than a radius of the iris. The general appearance of the array of grooves may be likened to the arms of a spiral directed in either a clockwise or a counterclockwise direction. If desired, the linear shape of each groove, as employed in the preferred embodiment of the invention, may be constructed with a curvature to resemble, more clearly, the arms of a spiral. Also, if desired, grooves may be disposed in both of the opposing surfaces of the iris plate, however, it is preferred that the arrays of grooves on one side of the plate are arranged in the same sense of spiral rotation as the grooves on the opposite side of the plate, namely, clockwise or counterclockwise.

In the preferred embodiment of the invention, the linear grooves are angled at approximately 20 degrees relative to a tangent to a circle enclosing the central coupling aperture. Each groove extends inwardly from the surface of the plate to a depth which is approximately three-quarters of the total depth of the plate. Thus, only the coupling aperture itself extends completely through the plate, as is required for the coupling of microwave energy from one side of the plate to the opposite side of the plate. In an alternative form of construction, the grooves may be cut completely through the plate and annular discs are soldered to the opposite sides of the plate to cover the grooves, the annular discs exposing the central coupling aperture to allow for the coupling of microwave energy between opposite sides of the iris. Each of the two annular discs has a thickness of approximately one-eighth the thickness of the base plate.

BRIEF DESCRIPTION OF THE DRAWING

The aforementioned aspects and other features of the invention are explained in the following description, taken in connection with the accompanying drawing wherein.

DETAILED DESCRIPTION

Figure 1:
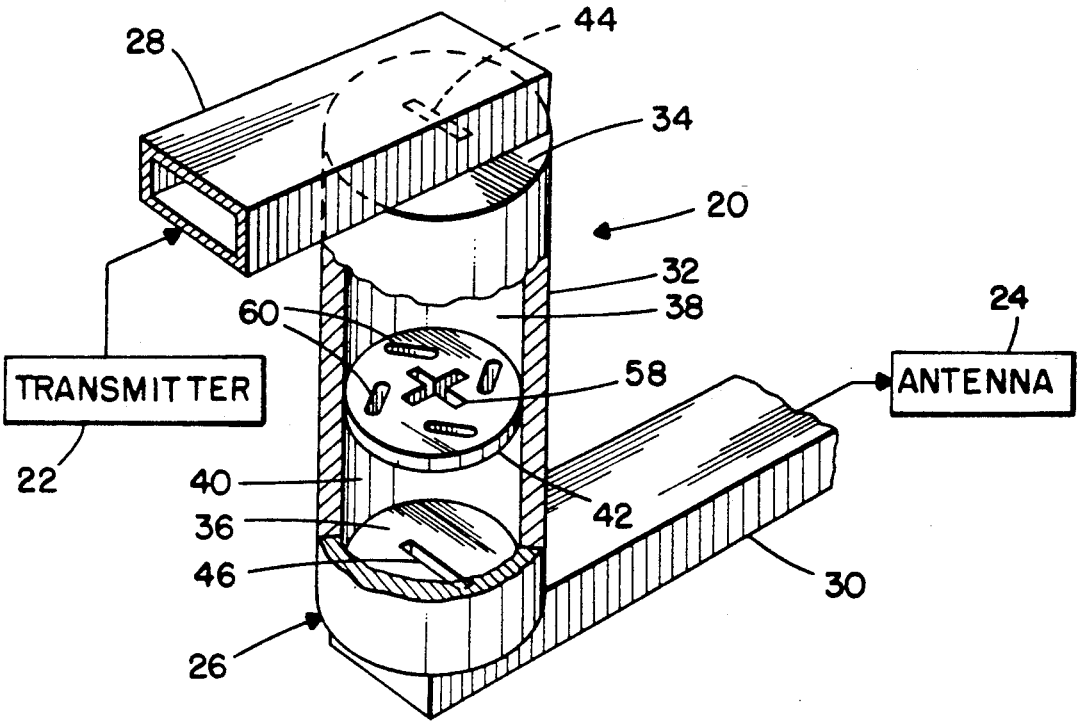
FIG. 1 is a stylized view of a microwave system showing interconnection of a filter with the components of the system, the filter being partially cutaway to show an iris constructed in accordance with the invention.

FIG. 1 shows an electromagnetic microwave transmission system 20, in a stylized view, suitable for use on a satellite encircling the earth. The figure shows only the rudiments of the system 20, and includes a transmitter 22 and an antenna 24 which are interconnected by a microwave filter 26. The filter 26 serves to provide a desired spectrum to a signal generated by the transmitter 22. The filter 26 is connected by a waveguide 28 to the transmitter 22, and by a waveguide 30 to the antenna 24. By way of example, the filter 26 is constructed of a cylindrical housing comprising an encircling cylindrical metallic sidewall 32 terminated by a first end wall 34 contiguous the waveguide 28, and by a second end wall 36 contiguous the waveguide 30. The interior of the housing is divided into two chambers or resonators 38 and 40 by an iris 42. The iris 42 is located equidistant between the end walls 34 and 36. The resonator 38 is located adjacent the waveguide 28, and the resonator 40 is located adjacent the waveguide 30. By way of further example, the coupling of microwave power between the waveguide 28 and the resonator 38 is accomplished by means of a slot 44 extending through a sidewall of the waveguide 28 and through the end wall 34. A similar slot 46 couples power between the resonator 40 and the waveguide 30.

The iris 42 is constructed in accordance with the invention so as to maintain dimensional stability even in the presence of heating of the filter 26 by the microwave power propagating through the filter 26. In order to appreciate the novel features in the construction of the filter 42 which provides the dimensional stability in the presence of heating, it is useful to consider an alternative construction of the filter, identified by the filter 26A in FIGS. 2 and 3, which employs an iris 48 having conventional construction.

Figure 2:
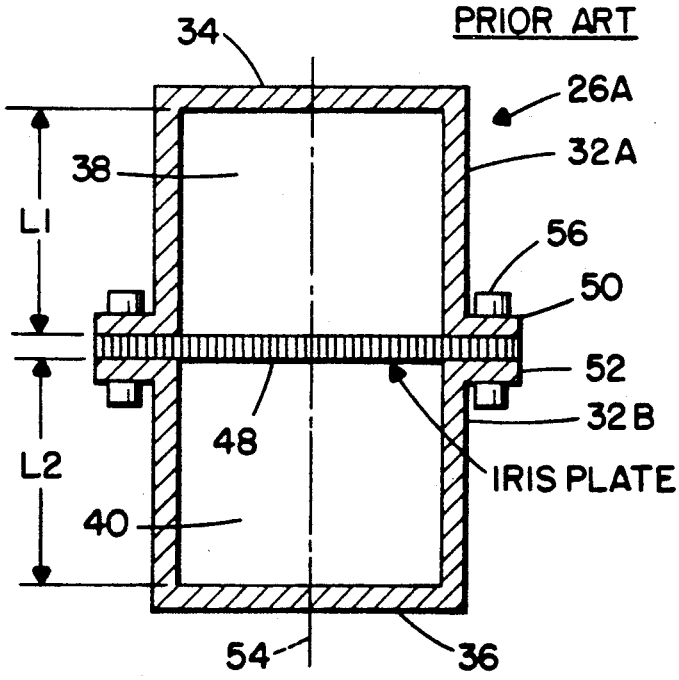
FIGS. 2 and 3 show groove and heated resonator assemblies of the prior art to demonstrate distortion of an iris plate induced by thermal expansion.
Figure 3:
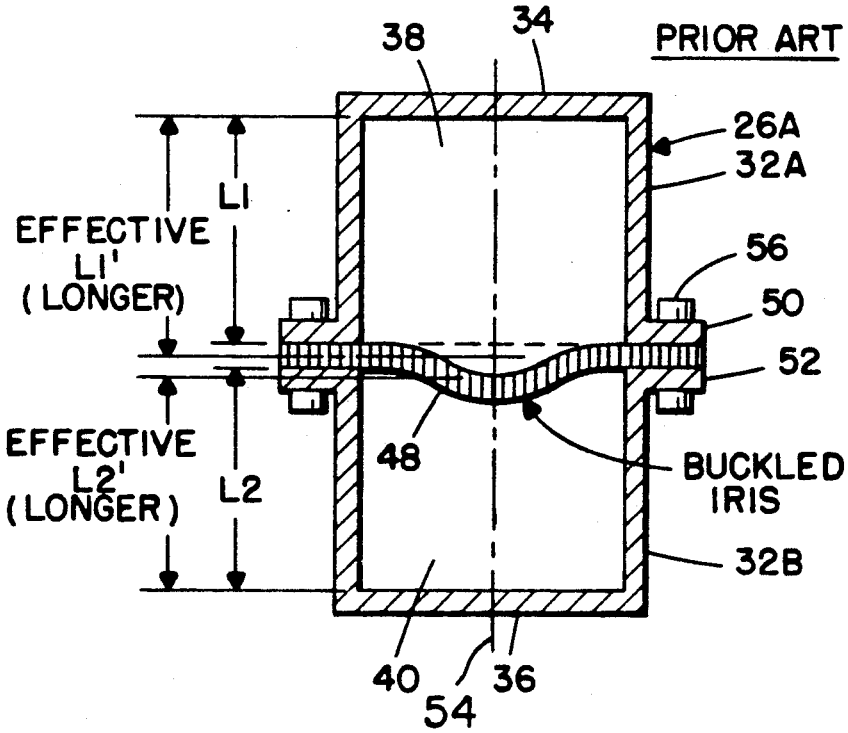

With reference to FIGS. 2 and 3, the filter 26A is constructed as follows. The sidewall is divided in two sections 32A and 32B . The sidewall section 32A terminates in a circumferential flange 50. The sidewall section 32B terminates in a circumferential flange 52. The iris 48 extends laterally across a longitudinal cylindrical axis 54 and is held by a peripheral portion of the iris 48 between the flanges 50 and 52 by bolts 56 which pass through the flanges 50 and 52 and through the peripheral portion of the plate from which the iris 48 is constructed. The filter housing comprising the end walls 34 and 36 and the sidewall sections 32A and 32B is fabricated of a metal, preferably Invar alloy, having a relatively low coefficient of thermal expansion. The iris 48, which would normally be constructed of Invar alloy so as to have the same coefficient of thermal expansion as the filter housing is constructed, in the embodiment of FIGS. 2 and 3, of a metal, such as aluminum, having a relatively high coefficient of thermal expansion. The showing of the construction of the filter 26A in FIGS. 2 and 3 has been simplified by elimination of the coupling slots 44 and 46 (FIG. 1) as well as a coupling aperture of the iris 48.

In FIG. 2, the filter 26A is shown prior to the heating of the filter by passage of microwave power. Accordingly, the iris 48 has a flat planar shape. FIG. 3 shows the filter 26A after heating by the passage of microwave power. Because of the relatively low coefficient of thermal expansion, the filter housing has undergone essentially no enlargement of dimension in FIG. 3. However, the aluminum iris 48 has undergone a significant amount of expansion due to the heating of the iris 48. As a result of the differential amount of elongation of the diameter of the iris 48 relative to elongation of the diameters of the end walls 34 and 36, the iris 48 buckles to extend into the resonator 40. The resonator 38 has an axial length L1, and the resonator 40 has an axial length L2. L1 and L2 may be equal to provide equal frequencies of resonance of the two resonators 38 and 40, or may differ slightly to provide a slight offset in the frequencies of resonance of the resonators 38 and 40. However, due to the buckling of the iris 48 in FIG. 3, the length L1 of the resonator 38 has a longer effective length L1, and the resonator 40 has a shorter effective length L2. Since the resonance frequency of each of the resonators 38 and 40 is proportional to the lengths L1 and L2, the shift in effective length results in a shift in the resonant frequencies from that which exists in the unheated case of FIG. 2. Therefore, FIGS. 2 and 3 demonstrate that, with a conventional construction of the iris 48, the iris 48 should not be constructed of aluminum but, rather, should be constructed of Invar alloy which is used in the housing of the filter 26A.

Figure 4:
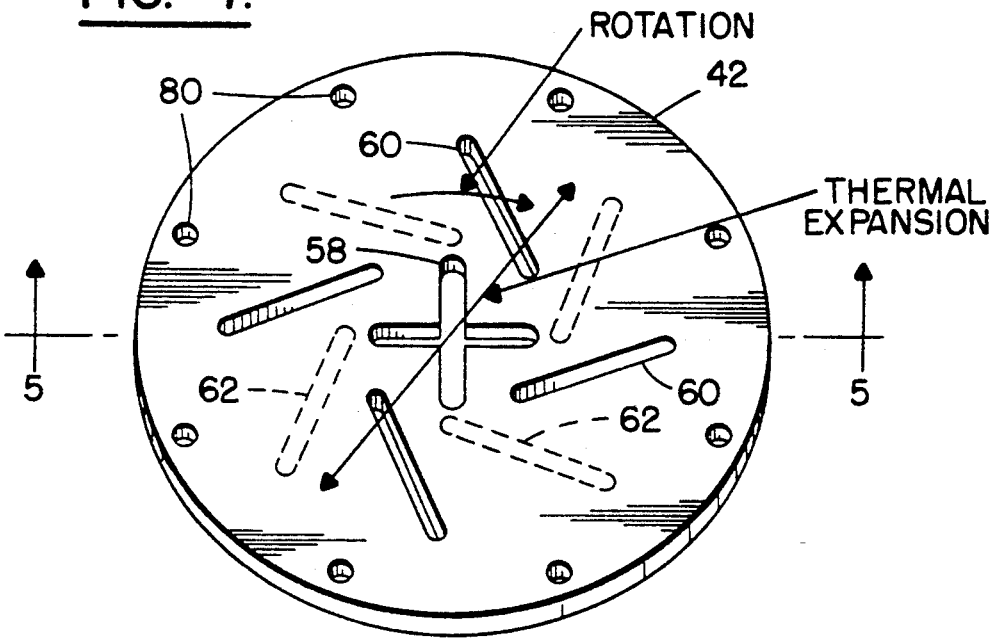
FIG. 4 is a perspective view of the iris plate of the invention.
Figure 5:
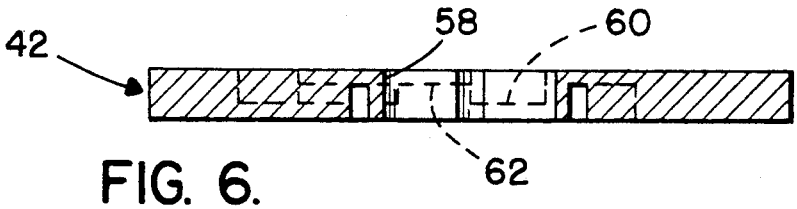
FIG. 5 is a sectional view of the iris plate taken along the line 5—5 in FIG. 4.
Figure 6:
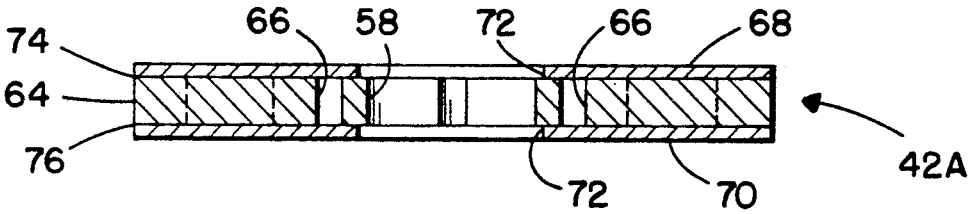
FIG. 6 is a sectional view, similar to that of FIG. 5, for a construction of the iris in accordance with an alternative embodiment of the invention in which the grooves are replaced with elongated apertures which extend completely through the iris plate and are closed off by annular discs.

In accordance with the invention, and with reference to FIGS. 1, 4 and 5, the iris 42 includes a central coupling aperture 58 surrounded by a set of stress-relieving grooves 60. In accordance with the invention, the grooves 60 provide for absorption of thermally induced stress by allowing for a rotational migration of material of the iris plate, this being effective to maintain the flat planar configuration to the plate of the iris, 42. While four grooves 60 are shown in a top surface of the iris 42 and an additional four grooves 62 are provided in the bottom side of the plate of the iris 42 (see FIG. 4), it is to be understood that other numbers of grooves may be employed, such as a number of grooves ranging from 6 grooves to 16 grooves (not shown). As shown for example in FIG. 5, the grooves 60 extend three-quarters of the plate depth from the top surface towards the bottom surface of the iris plate. Similarly, the grooves 62 extend from the bottom surface three-quarters of the plate depth towards the top surface of the iris plate. In an alternative construction shown in FIG. 6, an iris 42A comprises a plate 64 with grooves 66 extending completely through the plate 64 from a top surface of the plate 64 to a bottom surface of the plate 64. The grooves 66 are closed off at the top surface of the plate 64 by an annular disk 68, and at the bottom surface of the plate 64 by an annular disk 70. The same coupling aperture 58 is employed in both of the irises 42 (FIG. 5) and 42A (FIG. 6). A central opening 72 in each of the disks 68 and 70 exposes the coupling aperture 58 to the microwave power for coupling of the power through the iris 42A. By way of example in the construction of the iris 42, the plate of the iris 42 has a thickness of 20 mils, and each of the grooves 60 and 62 extends a distance of 15 mils into the plate. In the alternative configuration of the iris, namely, the iris 42A as seen in FIG. 6, the plate 64 has a thickness of 20 mils, and each of the disks 68 and 70 has a thickness of 3 mils. As shown for example in FIG. 6, the disk 68 is soldered at 74 to the plate 64, and the disk 70 is soldered at 76 to the plate 64.

Figure 7:
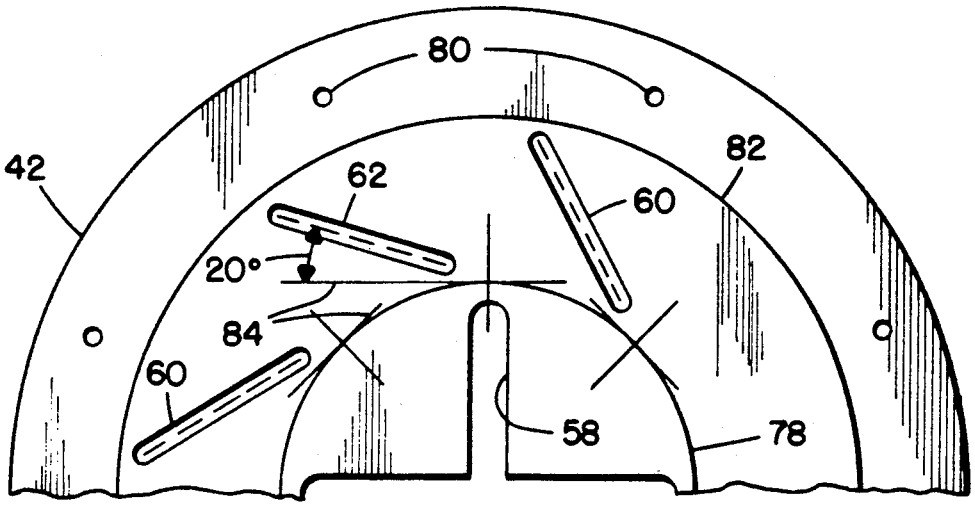
FIG. 7 is a diagrammatic view of a portion of the iris showing inclination of stress relief grooves relative to tangents of a circle enclosing a central coupling aperture.

FIG. 7 shows the geometrical arrangement of the grooves 60 and 62 on the iris 42. The coupling aperture 58 is surrounded by a circle 78. Apertures 80 (shown also in FIG. 4) are provided for receiving the bolts 56 (FIGS. 2 and 3). The circle 82 designates the boundary of the sidewall 32 (FIG. 1), or the sidewall sections 32A and 32B (FIGS. 2 and 3). The grooves 60 and 62 are disposed between the circles 78 and 82. Each of the grooves 60 and 62 is angled relative to a tangent 84 of the circles 78, the angulation being approximately 20 degrees as shown in FIG. 7. Other angulations may be used in the range extending from approximately 15 degrees up to approximately 40 degrees. The ends of each of the grooves 60 and 62 are spaced apart from the coupling aperture 58 and the circle 82.

Figure 8:
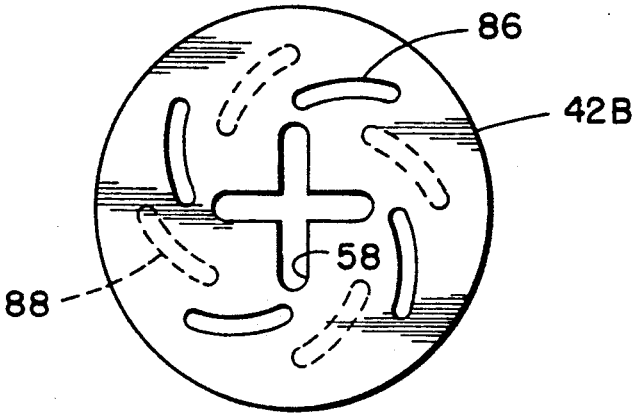
FIG. 8 shows an alternative embodiment of the iris constructed with stress-relief grooves having an arcuate shape.

FIG. 8 shows an iris 42B which is an alternative embodiment of the iris 42. In the iris 42B, grooves 86 and 88 are provided in lieu of the grooves 60 and 62, the grooves 86 and 88 having an arcuate shape as distinguished from the linear shape of the grooves 60 and 62. Also, by way of example, the grooves 86 and 88 are shown in an array corresponding to the arms of a clockwise spiral, while the linear grooves 60 and 62 (FIG. 4) are shown as being part of a counterclockwise spiral array. With the exception of the replacement of the linear grooves with the arcuate grooves in FIG. 8, further details in the construction of the iris 42B are the same as that of the iris 42. Also, it is noted that the grooves 66 in the embodiment of FIG. 6 can also be provided with an arcuate shape, such as the arcuate shape of the grooves shown in FIG. 8. For simplicity of presentation of the features of the invention, the bolt apertures 80 (FIG. 4) have been deleted in FIGS. 5, 6, and 8.

The operation of the grooves for relieving thermally induced stresses in the iris 42, as well as in the alternative embodiments 42A and 42B of the iris is explained best with respect to FIG. 4. Therein, it is noted that thermal expansion which proceeds along a diameter of the iris 42 is converted by the spiral arrangement of the grooves into a rotational movement rather than a buckling movement as disclosed in FIG. 3. Thereby, the flat planar shape of the surfaces of the iris 42 is retained during heating of the filter 26.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. In an electromagnetic energy resonant structure having at least one resonant chamber, the chamber being defined by an outer boundary, a wall operatively integrated with and providing at least a portion of the resonant chamber outer boundary, the wall comprising:

a plate having at least one side facing the resonant chamber for providing said at least a portion of the resonant chamber outer boundary; and an array of elongated expansion grooves extending at least partway through the plate for relieving thermal stress in the plate.

2. The wall of claim 1 wherein the wall consists essentially of a first material and the resonant structure consists essentially of a second material, the first material having a higher coefficient of thermal expansion than the second material.

3. The wall of claim 2 wherein the first material comprises aluminum and the second material comprises a 36% nickel steel alloy.

4. The wall of claim 1 wherein the at least one chamber of the resonant structure comprises a first resonant chamber and a second resonant chamber adjacent the first chamber, and wherein the wall separates the first and second chambers from each other, the wall further comprising an aperture in the plate for coupling electromagnetic energy through the plate between the first and second chambers.

5. The wall of claim 4 wherein the electromagnetic structure has a resonant cavity comprising the first and second chambers, the cavity being defined by a first endwall, a second opposite endwall and a sidewall extending between the first and second endwalls, the first resonant chamber being adjacent to and, in part, defined by the first endwall and the second resonant chamber being adjacent to and, in part, defined by the second opposite endwall, the cavity having a major axis extending from the first endwall to the second endwall, and wherein, the plate is substantially planar, operatively connected to the sidewall and extends across the cavity substantially perpendicular to the major axis to separate and, in part, define the first and second chambers.

6. The wall of claim 5 wherein each groove lies in a plane defined by the substantially planar plate and is elongated in a direction that is inclined relative to a line extending from the major axis to the sidewall.

7. The wall of claim 5 wherein the grooves have radial symmetry with respect to the major axis.

8. The wall of claim 5 wherein the grooves are spaced apart from each other and extend outward from a point at which the major axis intersects the plate.

9. The wall of claim 4 wherein the plate has a first side facing the first resonant chamber and a second side facing the second resonant chamber and wherein some of the elongated grooves of the array extend partially into the plate from the first side of the plate and others of the elongated grooves of the array extend partially into the plate from the second side of the plate.

10. The wall of claim 1 wherein the grooves are linear in shape.

11. The wall of claim 1 wherein the grooves are arcuate in shape.

12. The wall of claim 1 wherein the grooves extend completely through the plate.

13. The wall of claim 12 further comprising a cover adjacent the plate to prevent the flow of electromagnetic energy through the grooves.

14. The wall of claim 13 wherein the cover is in contact with and connected to the plate.

* * * * *